US008336278B2

(12) United States Patent
Smith et al.

(10) Patent No.: US 8,336,278 B2
(45) Date of Patent: Dec. 25, 2012

(54) STRUCTURAL PAVER DECKING ASSEMBLY AND METHOD FOR SAME

(75) Inventors: Steven George Smith, St. Michael, MN (US); Troy Achterkirch, Rogers, MN (US); Steven John Thorkelson, Minnetonka, MN (US)

(73) Assignee: VAST Enterprises, LLC, Minneapolis, MN (US)

( * ) Notice: Subject to any disclaimer, the term of this patent is extended or adjusted under 35 U.S.C. 154(b) by 70 days.

(21) Appl. No.: 12/717,856

(22) Filed: Mar. 4, 2010

(65) Prior Publication Data

US 2010/0223880 A1 Sep. 9, 2010

Related U.S. Application Data

(60) Provisional application No. 61/157,477, filed on Mar. 4, 2009.

(51) Int. Cl.
*E04B 1/00* (2006.01)

(52) U.S. Cl. ..... 52/747.12; 52/603; 52/605; 52/598; 52/477

(58) Field of Classification Search ..... 52/650.3, 52/302, 477, 474, 589, 603, 605, 747.1, 747.11, 52/747.2

See application file for complete search history.

(56) References Cited

U.S. PATENT DOCUMENTS

| | | | | | |
|---|---|---|---|---|---|
| 401,030 | A | | 4/1889 | Harger | |
| 3,233,896 | A | * | 2/1966 | King | 473/433 |
| 4,655,018 | A | * | 4/1987 | Pardo | 52/302.3 |
| 4,885,882 | A | * | 12/1989 | Forshee | 52/177 |
| 5,226,273 | A | * | 7/1993 | Burke | 52/390 |
| 5,267,810 | A | | 12/1993 | Johnson | |
| 5,313,756 | A | * | 5/1994 | Ways et al. | 52/263 |
| 5,429,451 | A | | 7/1995 | Pettee, Jr. | |
| 5,850,720 | A | * | 12/1998 | Willis | 52/650.3 |
| 6,055,784 | A | | 5/2000 | Geiger | |
| 6,071,041 | A | | 6/2000 | Knight | |

(Continued)

FOREIGN PATENT DOCUMENTS

DE 29710241 8/1997

(Continued)

OTHER PUBLICATIONS

"U.S. Appl. No. 12/990,419, Non Final Office Action mailed Mar. 22, 2012", 22 pgs.

(Continued)

*Primary Examiner* — William Gilbert
*Assistant Examiner* — Gisele Ford
(74) *Attorney, Agent, or Firm* — Schwegman Lundberg Woessner P.A.

(57) ABSTRACT

A method for forming a structural paver deck assembly includes fastening structural decking panels across a bare frame structure. One or more of the decking panels includes an upper panel surface having a non-planar contoured decking panel surface. A paver decking surface is seated over the plurality of structural decking panels to form a paver decking surface. Seating includes positioning a plurality of paver pieces on the structural decking panels including interfittingly engaging the paver pieces to the non-planar contoured decking panel surface. Seating further includes aligning the plurality of paver pieces in at least one specified direction, wherein the paver pieces includes paver contour surfaces along a lower surface having a corresponding shape to the non-planar contoured decking panel surface. Interfitting engagement of the paver contour surfaces with the non-planar contoured panel surface orients the one or more paver pieces in the at least one specified direction.

34 Claims, 11 Drawing Sheets

U.S. PATENT DOCUMENTS

| | | | | |
|---|---|---|---|---|
| 6,171,015 | B1 | 1/2001 | Barth | |
| 6,233,896 | B1 * | 5/2001 | Coup | 52/586.1 |
| 6,422,784 | B1 | 7/2002 | Pellegrino et al. | |
| 6,508,607 | B1 | 1/2003 | Smith et al. | |
| 6,594,961 | B2 * | 7/2003 | Leines | 52/177 |
| 6,769,217 | B2 * | 8/2004 | Nelson | 52/582.1 |
| 6,872,434 | B2 * | 3/2005 | Zen | 428/36.9 |
| 7,028,437 | B2 * | 4/2006 | Hauck | 52/302.1 |
| 7,237,766 | B2 * | 7/2007 | Lemay | 256/34 |
| 7,270,497 | B2 * | 9/2007 | Von Langsdorff | 404/39 |
| 7,344,334 | B2 * | 3/2008 | Thorkelson | 404/29 |
| 7,441,378 | B2 * | 10/2008 | Wood | 52/177 |
| D581,549 | S | 11/2008 | Thorkelson | |
| 7,503,146 | B2 * | 3/2009 | Thomas | 52/177 |
| 2002/0095896 | A1 * | 7/2002 | Commins et al. | 52/483.1 |
| 2005/0284082 | A1 * | 12/2005 | Smith | 52/650.3 |
| 2007/0269265 | A1 | 11/2007 | Thorkelson | |
| 2008/0168732 | A1 * | 7/2008 | Stuchell | 52/426 |
| 2011/0052318 | A1 | 3/2011 | Smith et al. | |
| 2012/0034030 | A1 | 2/2012 | Smith et al. | |

FOREIGN PATENT DOCUMENTS

| | | | |
|---|---|---|---|
| GB | 2367086 | 3/2002 | |
| WO | WO-2009134237 | A1 | 11/2009 |
| WO | WO-2010102143 | A1 | 9/2010 |

OTHER PUBLICATIONS

"U.S. Appl. No. 12/990,419, Response filed Nov. 11, 2011 to Restriction Requirement mailed Oct. 19, 2011", 14 pgs.

"U.S. Appl. No. 12/990,419, Restriction Requirement mailed Oct. 19, 2011", 5 pgs.

"U.S. Appl. No. 13/254,367, Preliminary Amendment filed Oct. 28, 2011", 9 pgs.

"International Application Serial No. PCT/US2008/013153, International Search Report mailed Mar. 20, 2009", 3 pgs.

"International Application Serial No. PCT/US2008/013153, Written Opinion mailed Mar. 20, 2009", 8 pgs.

"International Application Serial No. PCT/US2010/026263, International Search Report mailed Apr. 30, 2010", 2 pgs.

"International Application Serial No. PCT/US2010/026263, Written Opinion mailed Sep. 15, 2011", 7 pgs.

"U.S. Appl. No. 12/990,419, Response filed Jun. 22, 2012 to Non Final Office Action mailed Mar. 22, 2012", 17 pgs.

* cited by examiner

STRUCTURAL PAVER DECKING ASSEMBLY AND METHOD FOR SAME

RELATED APPLICATIONS

This document is a continuation-in-part application and claims priority to U.S. Provisional Patent Application Ser. No. 61/157,477 filed on Mar. 4, 2009 and incorporated herein by reference.

TECHNICAL FIELD

Decking and decking surfaces.

BACKGROUND

Decks are used in a variety of commercial, municipal and residential applications to provide an elevated outdoor space. Generally decks are constructed with a deck frame elevated from an underlying surface by posts and attached to another structure, for example, a home. Decking boards are cut to the length of the deck frame and fastened to the frame with screws, nails and the like. Generally, the decking boards are cut to the length of the deck frame to avoid unattractive seams between decking board ends. However, long decking boards are subject to warping over time and can separate from the deck frame requiring refastening or replacement of the board. Additionally, the fasteners used to couple the decking boards with the deck frame are unattractive and provide a blemished appearance to the decking boards.

BRIEF DESCRIPTION OF THE DRAWINGS

FIG. 3G is a perspective view showing a structural decking panel including a structural sheet with a rail configuration for coupling with a paver having complementary recesses.

DESCRIPTION OF THE EMBODIMENTS

In the following detailed description, reference is made to the accompanying drawings which form a part hereof, and in which is shown by way of illustration specific embodiments in which the invention may be practiced. These embodiments are described in sufficient detail to enable those skilled in the art to practice the invention, and it is to be understood that other embodiments may be utilized and that structural changes may be made without departing from the scope of the present invention. Therefore, the following detailed description is not to be taken in a limiting sense, and the scope of the present invention is defined by the appended claims and their equivalents.

Figure 1:
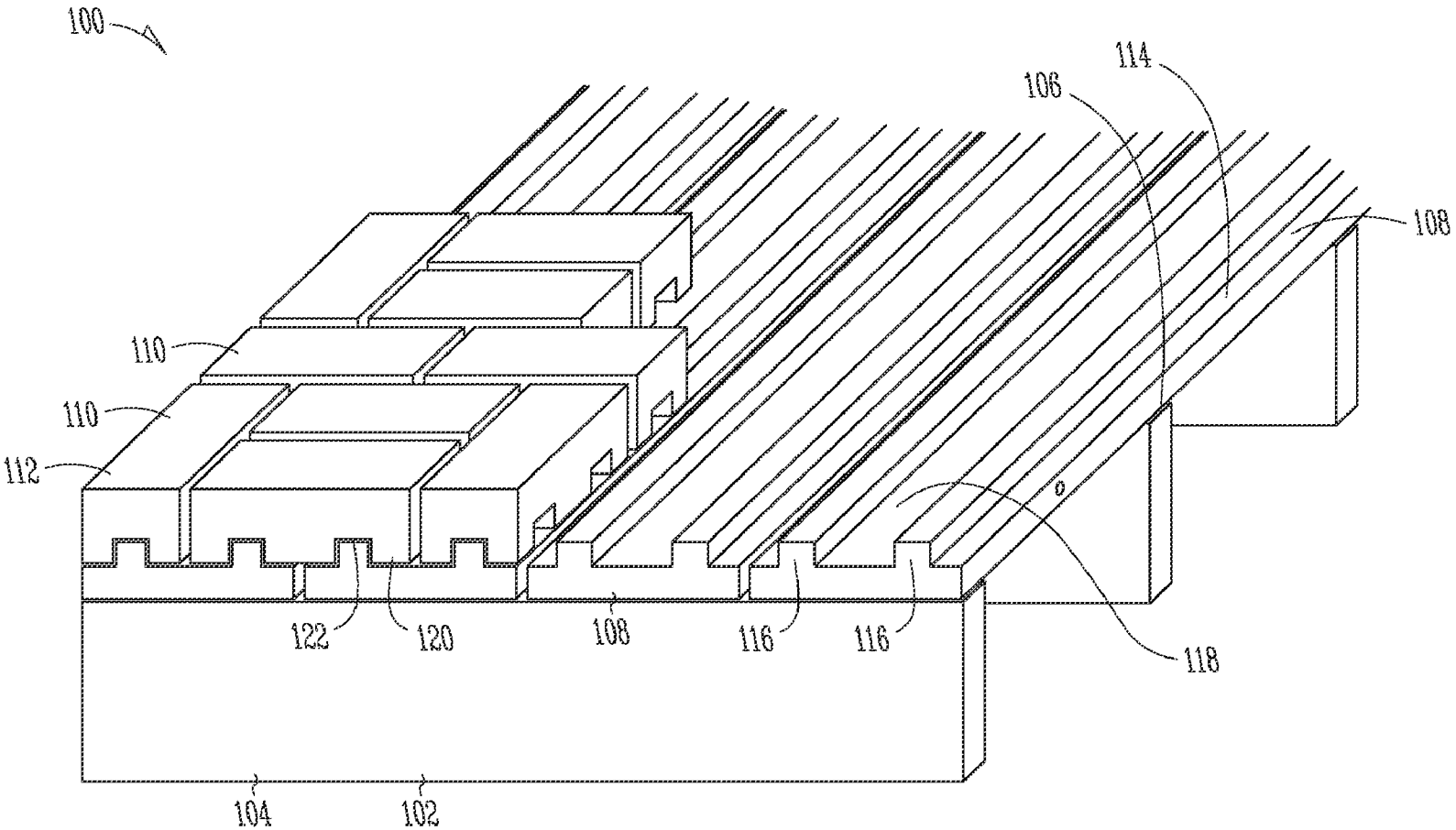
FIG. 1 Is an isometric view showing one example of a structural decking assembly.

FIG. 1 shows one example of a decking system 100, including a bare frame 102 composed of stringers 104 as well as, in some examples, headers and a ledger board. The headers and ledger boards are coupled at the ends of the stringers 104 to form the bare frame structure 102. The headers and ledger boards are not shown here in order to describe the bare frame 102 as it relates to the remainder of the decking system 100. The bare frame 102 includes a frame upper surface 106. The frame upper surface 106 is without deck boards and thereby provides the surface upon which the structural decking panels 108 are coupled for positioning with the paver pieces 110. The structural decking panels 108 are sized and shaped to orient and position the paver pieces 110 on the upper panel surface 114 of the structural decking panels without fasteners and the like. Additionally, the structural decking panels 108 provide a bracing structure to the paver pieces 110 with sufficient structural integrity to remain rigid while carrying the paver pieces 110 as shown in FIG. 1. Additionally, the structural decking panels 108 are configured to not only support the weight of the paver pieces 110 with only minimal deformation but are also configured to support the weight of equipment, individuals and the like standing or resting on the decking system 100. Stated another way, the structural decking panels 108 provide bracing support to ensure the decking system is maintained with little deformation at installation and during use.

The paver pieces 110 when installed on the structural decking panels 108 form a paver decking surface 112. As shown in FIG. 1, the paver decking surface 112 includes a decorative pattern of the paver pieces 110. In other examples, the paver pieces 110 are oriented on the upper panel surface 114 of the structural decking panels 108 according to the desired aesthetic pattern of the installer (e.g., in a herringbone configuration or the like). In the example shown in FIG. 1, the upper panel surface 114 of the structural decking panels 108 includes a non-planar contoured decking panel surface. For instance, the upper panel surface is formed by a combination of panel projections 116 and panel recesses 118. The panel projections and recesses 116, 118 cooperate with corresponding paver projections 120 and paver recesses 122 of the paver pieces 110 to interfit the paver pieces 110 with the structural decking panels 108. Interfitting of the paver pieces 110 with the corresponding features of the structural decking panels 108 (the panel recesses and the panel projections) orients the paver pieces 118 on the upper panel surface 114 in one or more desired orientations without measuring or fastening of the paver pieces 110 to the structural decking panels or the underlying bare frame 102. Stated another way, after fastening of the structural deck panels 108 to the bare frame 102 (without any intermediate boards therebetween) the paver pieces 110 are easily positioned on the upper panel surface 114 with the panel projections 116 and panel recesses 118 engaging with the corresponding paver projections and recesses 120, 122 to quickly couple and orient the paver pieces 110 into a desired configuration for the paver decking surface 112.

The decking system 100 is easily assembled and installed because the structural decking panels 108 are directly fastened to the stringers 104 of the bare frame 102. Stated another way, intermediate boards used for instance with other deck assemblies, are absent from decking system 100 shown in FIG. 1. Instead, the structural decking panels 108 including the panel projections 116 and panel recesses 118 are directly engaged with the bare frame 102 to provide a contoured upper panel surface 114 (e.g., a corrugated surface) for reception of the paver pieces 110. The paver pieces 110 are thereafter easily installed on the corrugated upper panel surface 114 and oriented on the upper panel surface according to the arrangement of the panel projections and recesses 116, 118 as they interfit with the paver projections and recesses 120, 122. That is to say, the structural decking panel 108 with the corrugated panel surface 104 automatically orients the paver pieces 110 as they are positioned over and coupled to the upper panel surface 114. Time consuming installation procedures including measuring, fastening and the like of the paver pieces 110 are thereby avoided.

The paver pieces 110, in one example, are constructed with, but not limited to, recycled consumer products including, for instance, butyl rubber. In another example, the paver pieces 110 include a composite material including polymers, ceramics, metals and the like in any combination thereof. In another example, the paver pieces 110 are constructed with materials including ultraviolet resistant materials that protect the paver pieces 110 from breakdown due to ultraviolet exposure. Further, the paver pieces 110, where resistant to ultraviolet radiation, similarly protect the underlying structural decking panels 108. The structural decking panels 108 beneath the paver pieces 110 are constructed with but not limited to one or more of nylon, steel, polymers, carbon fiber and the like. In other examples, the structural decking panels 108 are constructed with composite lumber structural nylon, aluminum and the like. The materials of the structural decking panel 108 provide sufficient structural integrity to the panel to support the weight of the paver pieces 110 as well as objects resting and moving on the paver decking surface 112 over the lifetime of the decking system 100. Because the paver pieces 110 overlay the structural decking panels 108 ultraviolet radiation incident on the paver pieces 110 is not transmitted to the structural decking panels 108. Advantageously, because the structural decking panels 108 are shielded from the ultraviolet radiation warping and break down of the structural decking panels 108 over time due to ultraviolet radiation is substantially minimized.

In one example, where the paver pieces 110 include ultraviolet resistant materials the paver pieces 110 are also resistant to damage from ultraviolet radiation. In still another example, the paver pieces 110 are not resistant to ultraviolet radiation. Because the paver pieces are positioned on the structural decking panels 108 according to the contoured features of the upper panel surface 114 and without fasteners, damaged paver pieces 110, for instance, paver pieces that are damaged by ultraviolet radiation (or physical harm) are easily exchanged for new paver pieces 110 that are installed on the upper panel surface 114 according to interfitting between the projections and recesses of the paver pieces and structural decking panels 116, 118, 120, 122. That is to say, the installer or owner easily replaces damaged paver pieces 110 without otherwise needing to replace the structural decking panels 108 that are concealed and protected by the paver pieces. The paver pieces provide ablative protection to the structural decking panels 108 as well as a decorative paver decking surface 112.

Figure 2A:
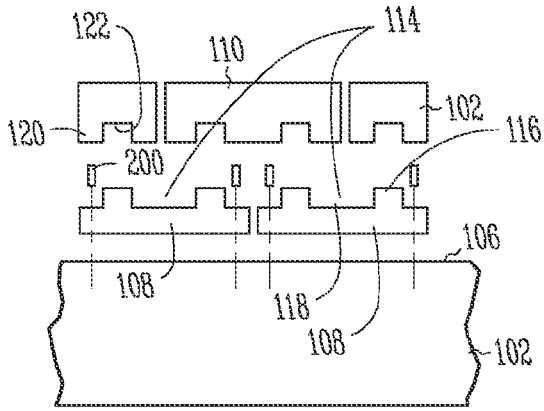
FIG. 2A is a side exploded view of the structural decking assembly shown in FIG. 1.

FIG. 2A shows the decking system 100 in an exploded configuration. The paver pieces 110 are oriented above the structural decking panels 108 and the structural decking panels are oriented above the bare frame 102. As previously described, the structural decking panels 108 are configured for direct coupling with the frame upper surface 106 without interposing deck boards therebetween. Fasteners 200 such as screws, nails and the like fasten the structural decking panels with the frame upper surface 106. After fastening of the structural decking panels 108 to the bare frame 102 the paver pieces 110 are thereafter installed over the upper panel surface 114 including a non-planar contoured decking panel surface composed of the panel projections 116 and panel recesses 118.

As shown in FIG. 2A as well as FIG. 1, the upper panel surface 114 extends across multiple structural decking panels 108 to form a substantially continuous surface with regular contours for positioning and orienting of the paver pieces 110 in a desired configuration. As previously described, the paver pieces 110 include paver projections and paver recesses 120, 122 configured to interfit with corresponding panel projections 116 and panel recesses 118 of the upper panel surface 114. Engagement between the panel projections and panel recesses 116, 118 and the corresponding paver projections and paver recesses 120, 122 orients the paver pieces 110 along the upper panel surface 104 in a decorative and aesthetic configuration without needing fasteners and the like to couple the paver pieces 110 with the decking system 100.

Figure 2B:
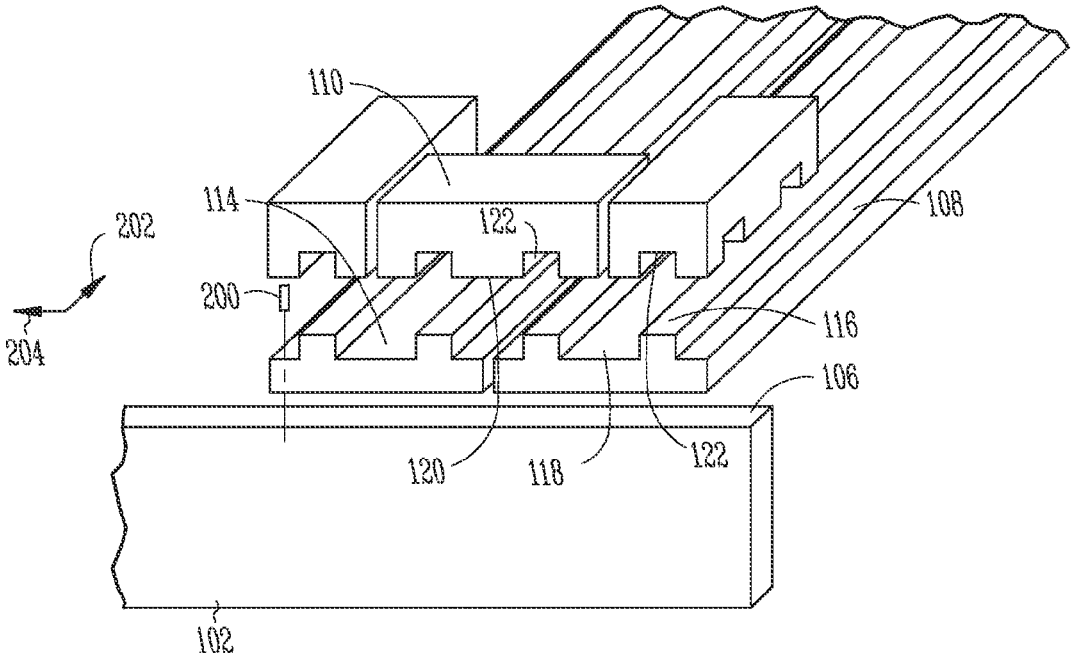
FIG. 2B is a perspective exploded view of the structural decking assembly shown in FIG. 1.

Referring now to FIG. 2B, an isometric exploded view is shown with the paver pieces 110 oriented above the structural decking panels 108. First and second direction arrows 202, 204 are shown. As previously described, the paver pieces 110 are interfit with features on the structural decking panels 108 including panel recesses 118 and panel projections 116 to orient and couple the paver pieces with the structural decking panels and thereby form a decorative paver decking surface 112. In one example, the panel projections 116 form paver rails sized and shaped for reception of the paver recesses 122. As shown in FIG. 2B, the paver pieces 110 are oriented in the first direction 202 or the second direction 204 according to the configuration of the paver pieces 110 and the panel projections 116. Because the panel projections 116 extend longitudinally (e.g., into and out of the page) the paver pieces 110 with the corresponding paver recesses 122 are oriented when positioned on the upper panel surface 114 in one of the first direction 202 and second direction 204. Installation of the paver pieces 110 in a decorative pattern is thereby easily accomplished through interfitting of the panel projections 116 with the paver recesses 122 (and corresponding reception of the paver projections 120 with the panel recesses 118). In other examples, the contoured features of the paver pieces 110 and structural decking panels 108 are formed in other configurations, for instance, where the paver pieces have octagonal, hexagonal, and other shapes the interfitting recesses and projections between the paver pieces 110 and the structural decking panels 108 are correspondingly formed to selectively orient the paver pieces 110 in corresponding decorative patterns.

Figure 3A:
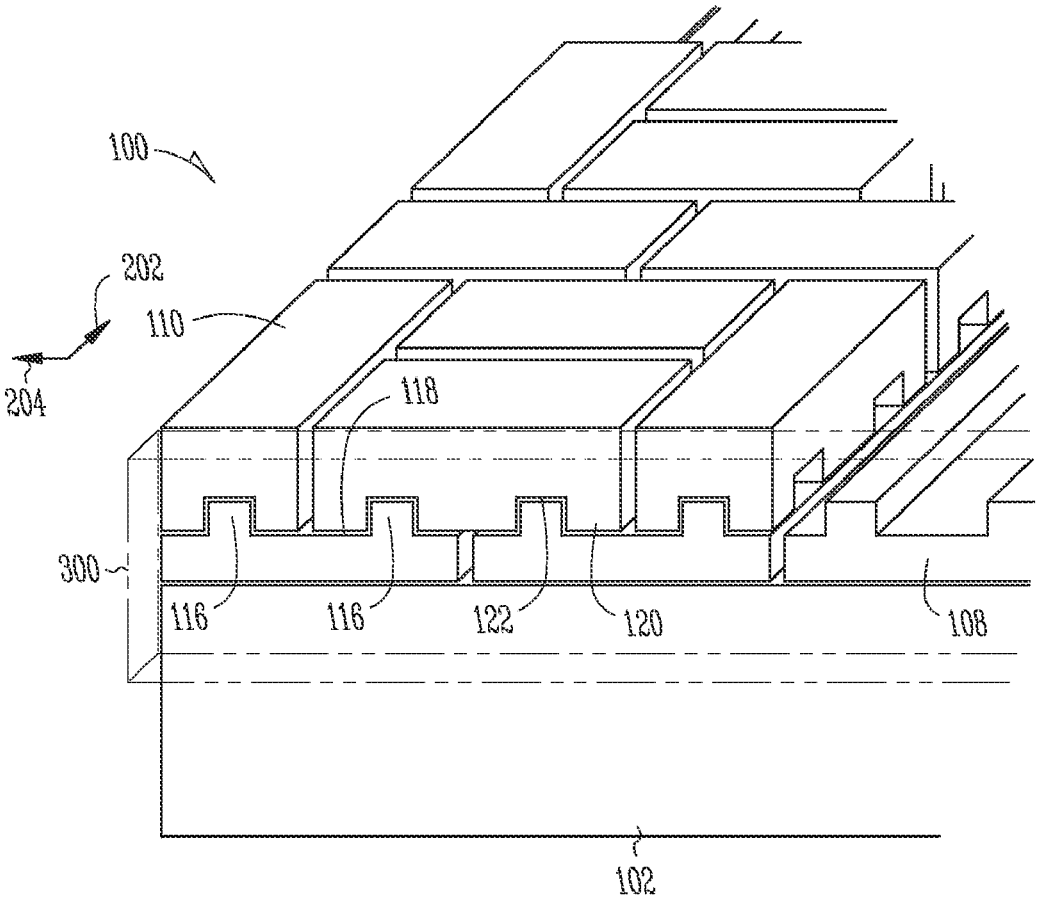
FIG. 3A is a side view showing one example of a structural decking panel including a rail configuration and a paver having a complementary rail recessed configuration.

Referring now to FIG. 3A, the decking system 100 is shown with a plurality of paver pieces 110 installed over the structural decking panels 108. A paver flange 300 is shown along the bare frame 102 and ends of the structural decking panels 108. The paver flange 300 extends along the structural decking panels 108 and the plurality of paver pieces 110 to substantially constrain longitudinal movement of the paver pieces 110 off of the structural decking panels.

As previously described, the panel projections 116 of the structural decking panels 108 form paver rails sized and shaped to slidably receive the plurality of paver pieces 110. For instance, the paver pieces 110 are positioned on the panel projections 116 according to interfitting between the panel projections and paver recesses 122 of the paver pieces. The Paver pieces 110 are thereafter slid along the structural decking panels 108 according to the interfit between the panel projections 116 and paver recesses 122 into the decorative configuration shown in FIG. 3A. In one example, the paver pieces 110 are slid in a direction incident with the direction arrow 202 shown in FIG. 3A. The paver pieces 110 are positioned on the structural decking panels 108 in a loose configuration and thereafter slid down the structural decking panels 108 into engagement with the paver flange 300. As the paver pieces 110 engage with the paver flange 300 the paver pieces 110 tightly stack up against the paver flange 300 in the decorative pattern shown in FIG. 3A. Because the plurality of paver pieces 110 include paver recesses 122 and paver projections 120 configured to couple the paver pieces in both of the directions 202, 204 the paver pieces 110 are also slidable in either orientation (e.g., orientations corresponding with the directions 202, 204). The paver pieces 110 are thereby positionable on the structural deck and panels 108 in either orientation and thereafter slid down the structural decking panels 108 into the packed decorative pattern shown.

Figure 3B:
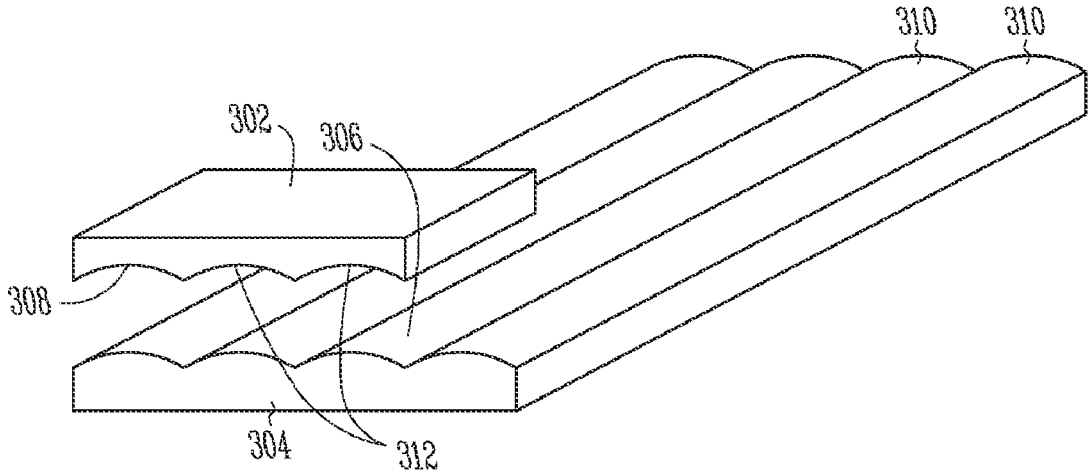
FIG. 3B is a side view showing multiple examples of structural decking panels and paver pieces including complementary contoured surfaces.
Figure 3B:
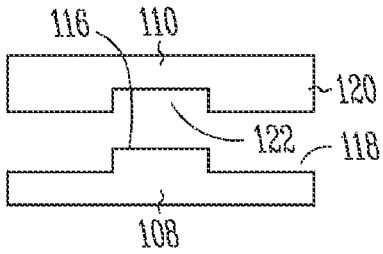
Figure 3B:
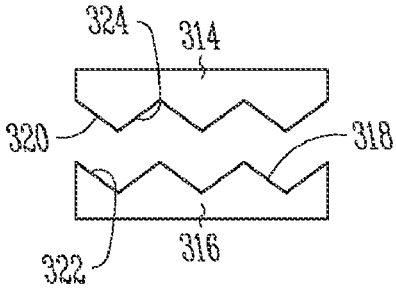
Figure 3B:
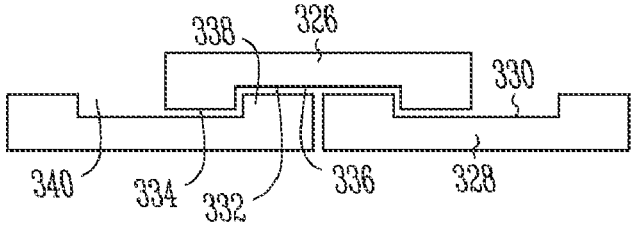

FIG. 3B shows multiple permutations of structural decking panels and paver pieces sized and shaped for engagement with the structural decking panels. In each of these examples, the paver pieces and structural decking panels are formed with contoured surfaces that orient the paver pieces according to the interfit between the paver pieces and the structural decking panels. As described above in FIG. 3A, the paver pieces shown in FIG. 3B are slidable along the structural decking panels to permit loose orientation and arrangement of the paver pieces on the structural decking panels and subsequent packing of the paver pieces into the decorative configuration desired.

The first example shown in FIG. 3 includes a paver piece 302 exploded relative to a decking panel 304. The structural decking panel 304 includes an upper panel surface 306 (e.g., a non-planar contoured decking panel surface). The paver piece 302 includes a corresponding paver contoured surface 308 sized and shaped for reception on the panel surface 306 and orienting of the paver piece in a desired direction. For instance, as shown the structural decking panel 304 includes deck corrugations 310 having a rounded shape and the paver piece 302 includes paver corrugations 312 having a corresponding shape. Engagement between the deck corrugations 310 and paver corrugations 312 orients the paver piece 302 and also orients additional paver pieces 302 positioned on the structural decking panel 304.

The next example includes the paver piece 110 and structural decking panel 108 shown in FIG. 1. As previously described, the paver piece 110 includes paver recesses 122 and paver projections 120 sized and shaped for interfitting with panel recesses 118 and panel projections 116. As described above, this configuration of the projections and recesses allows for orienting of the paver piece 110 in at least two directions and also facilitates sliding of the paver piece along the structural decking panel 108 into a desired packed decorative pattern.

In another example, a decking system configuration is shown with a paver piece 314 coupled along a structural decking panel 316. As with previous examples, the structural decking panel 316 provides an upper panel surface 318 and the paver piece 314 provides a paver contour surface 320. The paver contour surface 320 includes a paver saw tooth configuration 324. The paver saw tooth configuration 324 is complementary to a deck saw tooth configuration 322. Engagement between the saw tooth configurations 322, 324 orients the paver piece 314 in a specified direction. Orientation of the paver pieces 314 further allows for slidable movement of the paver piece 314 along the structural decking panel 316 according to the slidable engagement of the paver saw tooth configuration 324 with the deck saw tooth configuration 322.

In still another example shown in FIG. 3B, the paver piece 326 is shown coupled with the structural decking panel 328. As with the other examplesm the structural decking panel 328 includes an upper panel surface 330 while the paver piece 326 includes a paver contour surface 332. In this example, the panel projections 338 of two structural decking panels 328 form a composite projection received within the paver recess 336 of the paver piece 326. As shown in this configuration, the paver piece 326 bridges across the structural panels 328 and the paver projections 334 correspondingly bracket the panel projections 338. The engagement of the paver projections 334 with structural panel projections slidably couples the paver piece 326 with the structural decking panels 328 and substantially prevents lateral movement of the paver piece 326 relative to the structural decking panel (e.g., lateral movement including movement to the left and right of the page).

Figure 3C:
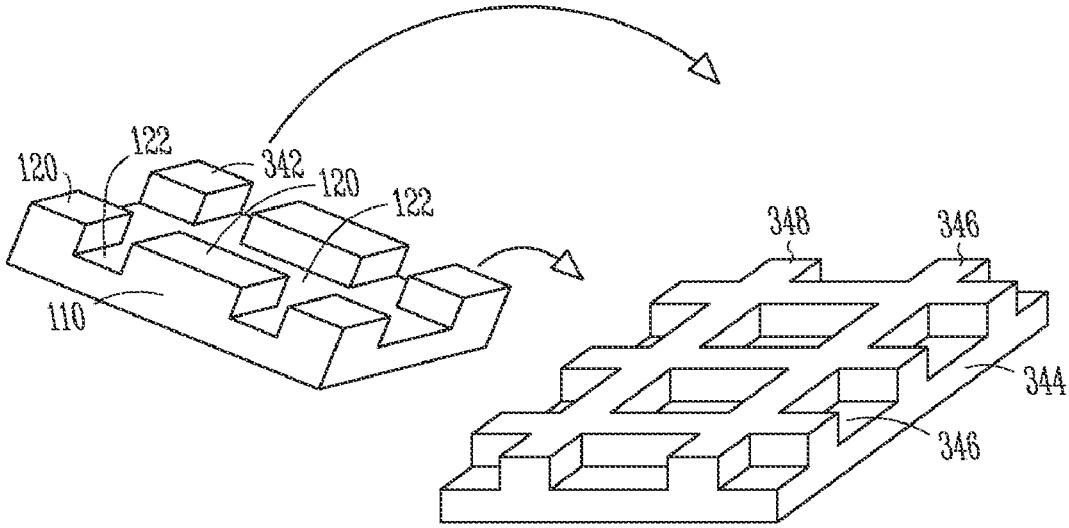
FIG. 3C is a perspective view showing still another example of a structural decking panel including a series of projections for coupling with a paver having complementary recesses.

FIG. 3C shows another example of a decking system including the paver piece 110 and a structural decking panel 344. In the example shown, the paver piece 110 includes a series of paver projections 120 and paver recesses 122 like those shown in previous figures. The paver projections and recesses 120, 122 form a paver contour surface 342 sized and shaped to interfit with the upper panel surface 346 of the structural decking panel 344. As shown in FIG. 3C, the upper panel surface 346 includes a panel projection 348 extending in a grid pattern across the structural decking panel 344. Interfitting of the paver piece 110 with the panel projection 348 engages the paver piece 110 with the structural decking 344 and substantially prevents lateral movement of the paver piece 110 across the structural decking panel 344. Although shown with a grid type projection across the structural decking panel 344, in other examples the structural decking panel includes, but is not limited to, a series of discrete projections sized and shaped to engage with the paver piece 110 to substantially prevent lateral movement of the paver piece 110 across the structural decking panel.

Additionally, as shown in FIG. 3C, the structural decking panel 344 is sized and shaped to receive one or more paver pieces 110. In other examples, the structural decking panel 344 comes in standard sizes including 4 foot by 6 foot sheets, 4 foot by 8 foot sheets and the like. Prior to installation, the structural decking panels 344 are cut to a desired size and shape and then installed on the bare frame 102. The paver pieces 110 are thereafter installed on the customized structural decking panels 344 without requiring the installation of the plurality of elongate structural decking panels across the bare frame. Stated another way, the structural decking panel 344 includes a large panel size that provides a sheet of projections for coupling a plurality of paver pieces 110. Fewer structural decking panels are needed for installation on the upper panel surface by using the structural decking panel 334 and assembly and installation times are thereby minimized.

Figure 3D:
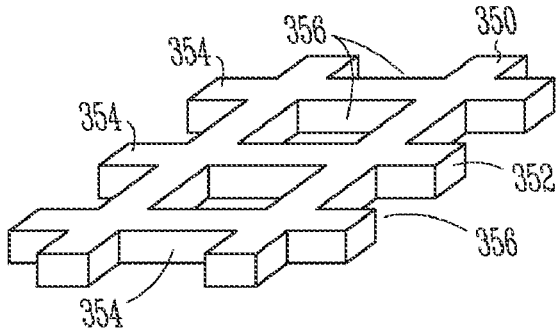
FIG. 3D is a perspective view showing yet another example of a structural decking panel including a screen substrate and a paver having complementary projections.

FIG. 3D shows another example of a structural decking panel 350 including a screen 352. The screen 352 includes a series of bars 354 interconnected to form the screen. In one example, the bars 354 include wires with sufficient structural integrity when coupled across the bare frame 102 to receive projections from the paver pieces within the screen openings 356 between the bars. The bars 354 of the screen 352 provide sufficient load bearing strength to bare the weight of the paver pieces installed on the screen 352 as well as objects and individuals positioned on the paver pieces lying over the structural decking panel 350 (e.g., screen 352) with minimized bowing of the deck surface. In one example, the structural decking panel 350 including the screen 352 is coupled across the bare frame with anchors including screws, nails and other fasteners. The structural decking panel 350 cooperates with the bare frame to provide sufficient support to the overlying paver pieces and substantially minimizes bowing of the paver decking surface created by the paver pieces after installation.

Figure 3E:
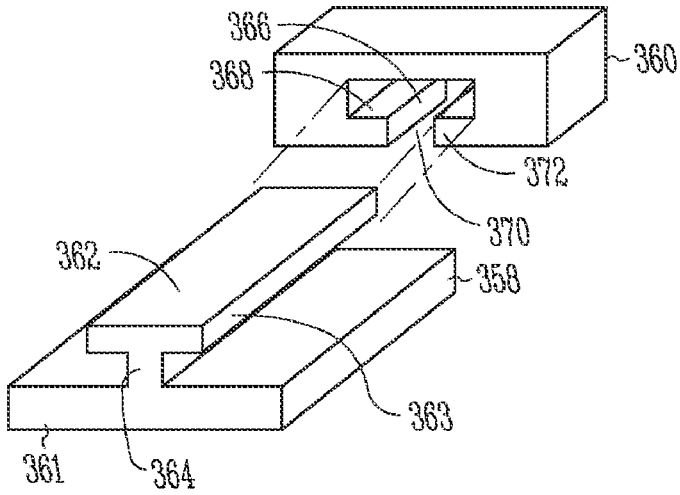
FIG. 3E is a side view showing a further example of a structural decking panel including a dual interlocking configuration and a paver having complementary dual interlocking recesses.

Referring now to FIG. 3E, another example of the structural decking panel 358 and paver piece 360 are shown. The structural decking panel 358 includes a panel base 361 with a panel projection 363 extending from the panel base 361. The panel projection 363 includes a panel projection head 362 and a narrower panel projection neck 364. In another example, the panel projection 363 is tapered with the panel projection head 362 having a greater width than the panel projection neck 364. A paver piece 360 includes a correspondingly shaped paver recess 366 having a paver recess cavity 368 wider than a paver recess opening 370. The paver recess opening 370 is sized and shaped to receive the panel projection neck 364 of the structural decking panel 358. The paver recess cavity 368 is correspondingly shaped to receive the panel projection head 362 of the decking panel. A paver recess flange to 372 extends over a portion of the paver recess cavity 368 to form the paver recess opening 370. Engagement of the paver recess flange 372 with the panel projection head 362 interlocks the paver piece 360 with the structural decking panel 358. Stated another way, after the paver piece 360 is slid on to the panel projection 363, lateral movement of the paver piece 360 (e.g., in a left or right direction across the page) is substantially prevented by the engagement of the panel projection head 362 with the paver recess flange 372. Further, the engagement between the paver recess flange 372 and the panel projection head 362 substantially prevents lateral movement in a direction upward from the structural decking panel 358 after the paver piece 360 is coupled with the panel. After installation along the structural decking panel, the paver piece 360 is retained on the panel projection 363 unless slid off the projection.

Figure 3F:
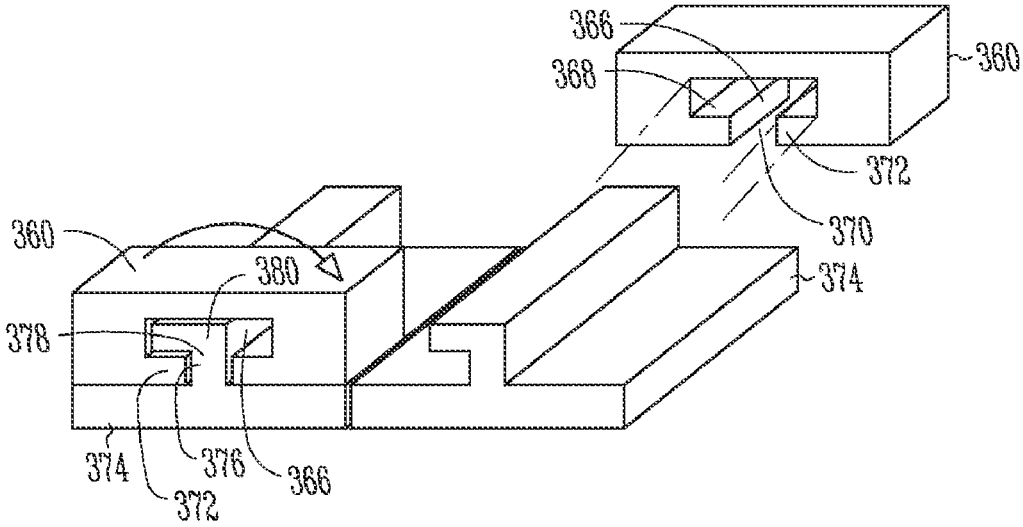
FIG. 3F is a side view showing an additional example of a structural decking panel including a switch handed single interlocking configuration and a paver having complementary dual interlocking recesses.
Figure 3C:
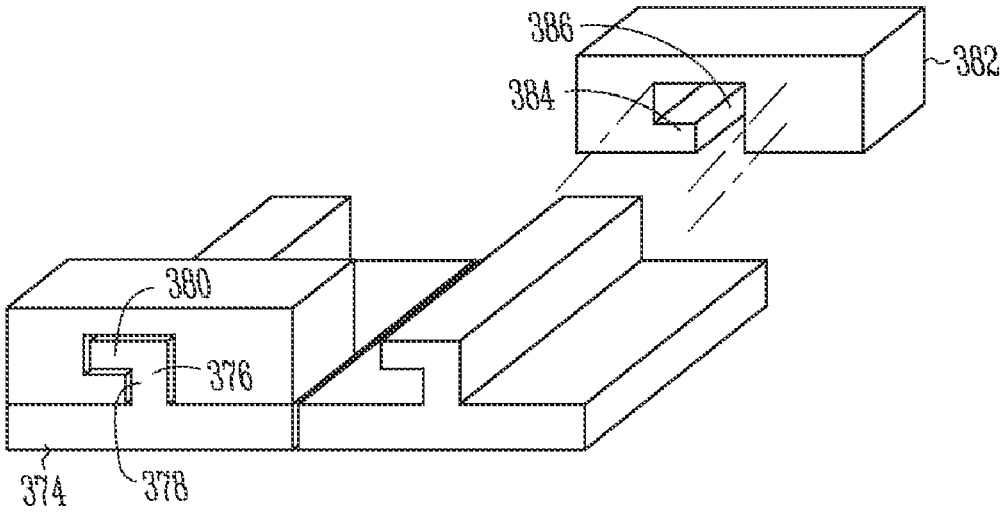

FIG. 3F shows another permutation of a structural decking panel 374 with the paver piece 360 shown in FIG. 3E. In FIG. 3F the panel projection 376 includes a panel projection neck 378 and a panel projection head 380. The panel projection head with the panel projection neck 378, 380 form an L shape where the panel projection head 380 is sized and shaped for reception within the panel recess cavity 368. Because the panel projection head and neck 378, 380 are formed in the L shape the paver recess 360 is configured for right or left-hand installation. Because the panel projection neck and panel projection head 378, 380 form an L shape, the paver piece 360 is installed on the structural decking panel 374 by engagement of one of the paver recess flanges 372 underneath the panel projection head 380. The paver piece 360 is thereafter rotated relative to the structural decking panel to snap fit the panel projection 376 into the paver recess cavity 368. With this configuration, the paver pieces 360 are easily installed along the structural decking panel 374 including the panel projection 376 through rotatable snap fitting of the paver pieces 360. Sliding of multiple paver pieces on to the panel projection 376 is thereby avoided in favor of installation of paver pieces near to the desired location for a decorative pattern. Additionally, the paver pieces 360 are easily removed from the structural decking panel 374 by rotation of the paver pieces out of the snap fitting engagement. Alternatively, the paver pieces 360 are installed by sliding along the panel projection 376.

FIG. 3G shows another example including the structural decking panel 374 previous described along with another example of a paver piece 382. The paver piece 382 shown in FIG. 3G includes an L-shaped paver recess cavity 386 having a paver recess flange 384 extending across a portion of the paver recess cavity 386. Slidable coupling of the paver piece 382 with the L-shaped panel projection 376 of the structural decking panel 374 interlocks the paver piece 382 with the structural decking panel and substantially prevents lateral movement of the paver piece 382 to the right, left or up relative to the structural decking panel.

Figure 3H:
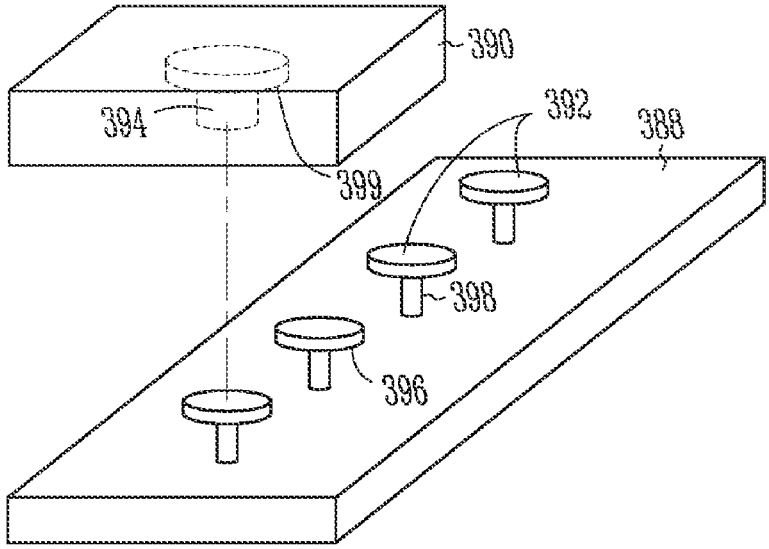
FIG. 3H is a perspective view showing a structural decking panel and a paver piece with snap fit features.

FIG. 3H shows yet another example of a decking system including a paver piece 390 and a structural decking panel 388. The structural decking panel 388 includes a series of panel projections 392 including, for instance, studs. The panel projections 392 include a stud neck 398 extending away from the structural decking panel 388 to a stud head 396 having a width greater than that of the stud neck 398. The paver piece 390 includes a corresponding paver recess cavity 394 sized and shaped to receive the panel projection 392. For instance, the paver piece 390 includes a paver recess flange 399 sized and shaped to engage beneath the stud head 396 of the paver projection 392. Downward movement of the paver piece 390 onto the paver projections 392 forces the paver projection 392 including the stud head 396 into the paver recess cavity 394 and allows the paver recess flange 399 to fit underneath the stud head 396 to interlock the paver piece 390 with the structural decking panel 388. In some examples, disassembly of the paver piece 390 from the structural decking panel 388 is possible with sufficient upward force applied to the paver piece 390 relative to the structural decking panel 388. In other examples, the engagement between the panel recess flange 399 and the stud head 396 of the panel projection 392 permanently engages the paver piece 390 with the structural decking panel 388.

Figure 4:
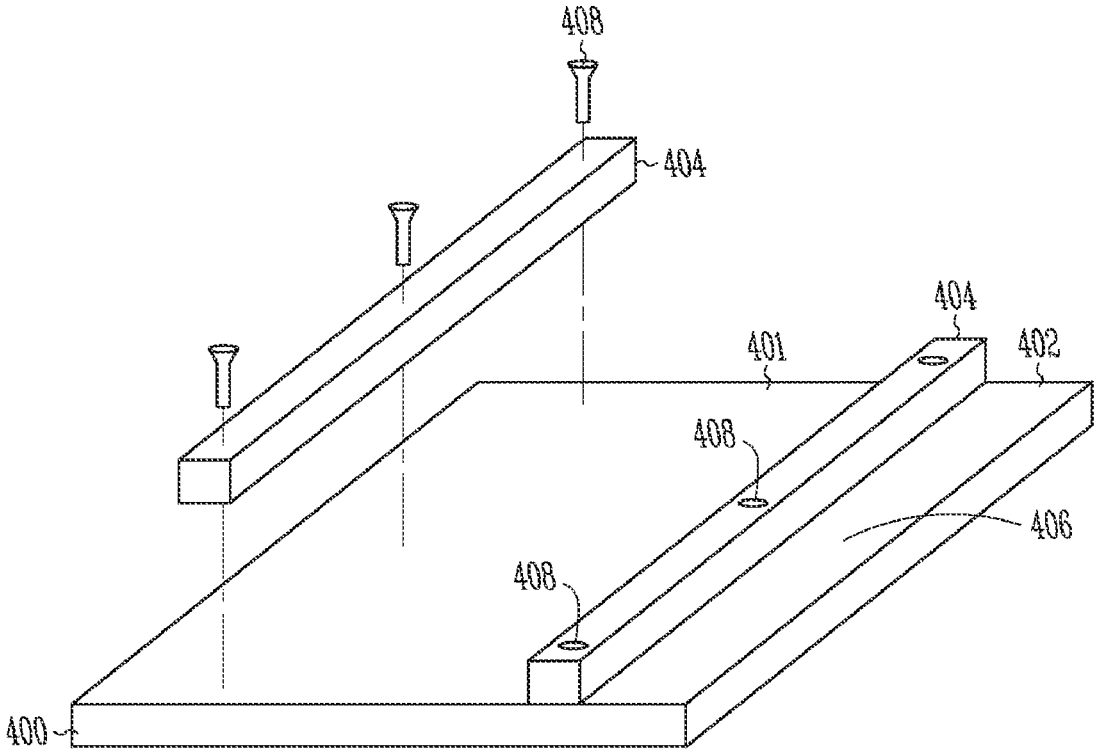
FIG. 4 is a partially perspective exploded view showing one example of a structural decking panel including separable rails.

FIG. 4 shows one example of a structural decking panel 400 formed in multiple pieces. The structural decking panel 400 includes a panel base 401 and one or more panel projections 404 sized and shaped for coupling with the panel base 401. The panel base 401 includes an upper panel surface 402 sized and shaped to receive the panel projections 404. As previously described in other examples, the panel projections 404 include paver rails, projections and the like sized and shaped to interfit with corresponding features on paver pieces, such as paver pieces 110 shown in FIG. 1. In one example, where the panel projection 404 includes a paver rail the paver pieces 110 are slidably coupled along the paver rails and positionable in a decorative configuration (see FIG. 1). For instance, the paver pieces 110 are loosely arranged in the desired decorative pattern and then slid down the structural decking panel 400 into a tightly packed pattern corresponding to the selected decorative configuration. In other examples the panel projection 404 includes a series of projections extending in two or more directions across the upper panel surface 402. The projections engage with corresponding features of the paver pieces 110 and substantially prevent lateral movement of the paver pieces across the panel surface of the structural decking panel 400.

As shown in FIG. 4, the panel projections 404 are separable from the structural decking panel 400. In one example, the panel projections 404 are positioned on the upper panel surface 402 and fastened to the surface with fasteners 408 (e.g., nails, screws, bolts and the like). With the panel projections 404 fastened across the structural decking panel 400 the upper panel surface 402 with the panel projections 404 form a non-planar contoured decking panel surface 406. The non-planar contoured decking panel surface, similar to the other contoured decking surfaces described above, provides a contoured surface for coupling and orientation of the plurality of paver pieces 110 (see FIG. 1).

The installer is able to install the panel projections 404 of the structural decking panel 400 according to the particular interfitting features of the paver pieces 110 and selected decorative pattern for the paver pieces. Stated another way, where a catalogue of paver pieces are available with a variety of different contoured surfaces for coupling with a structural decking panel, the installer is able to position and fasten the panel projections 404 on the structural decking panels 400 in the orientation necessary for coupling with the specified paver pieces. That is to say, the installer is able to purchase and install a single structural decking panel 400 having a generic configuration and then couple the panel projections 404 over the structural decking panel in the configuration needed for interfitting with the specified paver pieces. In still another example, the installer installs the panel projections 404 on a prelayed decking panel surface for a deck. The installation of the panel projections 404 allows for subsequent installation and interfitting of the plurality of paver pieces 110 on the non-planar contour decking panel surface 406 formed by the installed panel projections and existing upper panel surface 402. That is to say, the installer couples the panel projections 404 on an existing upper panel surface 402 of a deck and is thereafter able to couple and orient the paver pieces 110 on the non-planar contoured decking panel surface 406 created by the subsequently installed panel projections 404.

Figure 5:
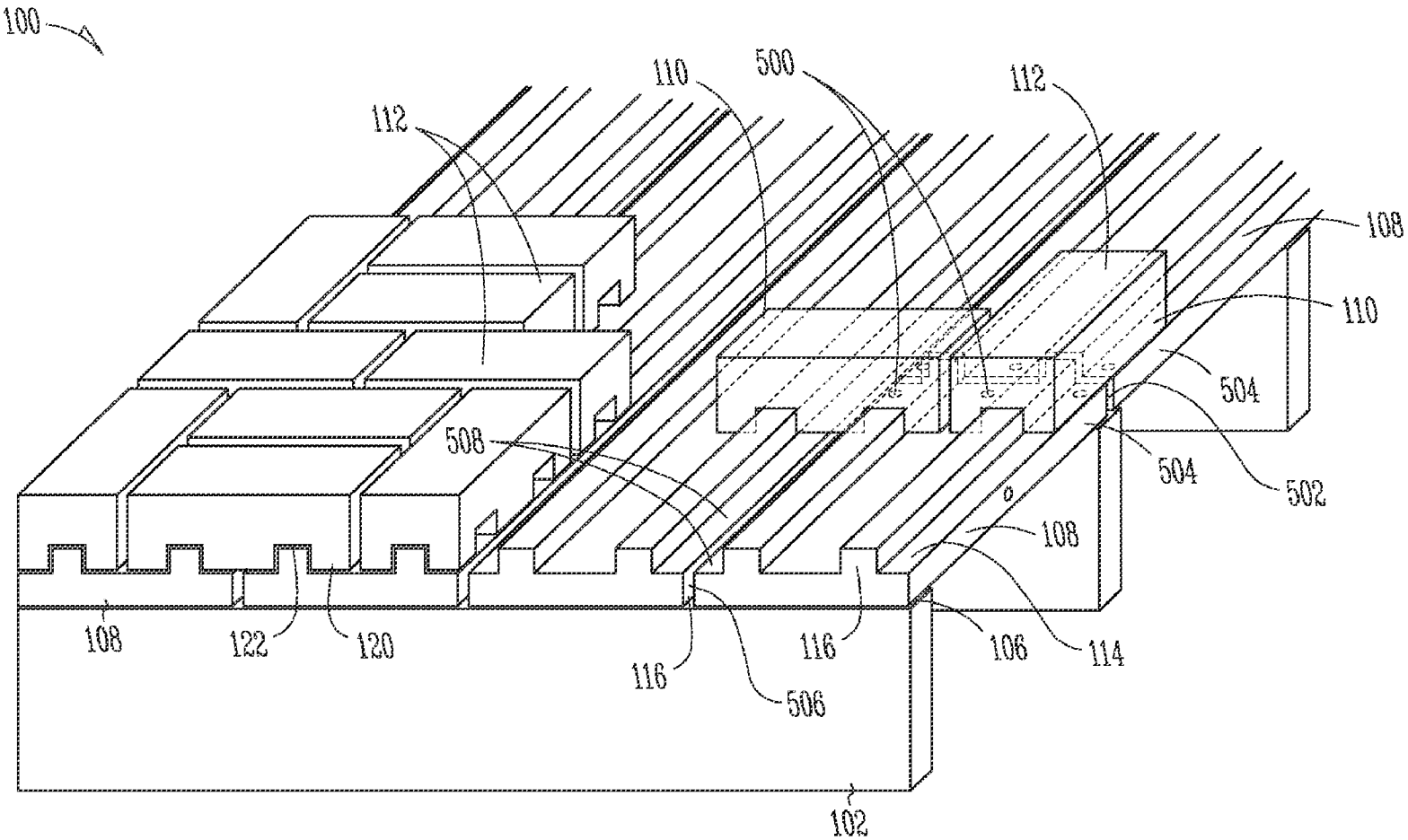
FIG. 5 is a plan view showing one example of a partially assembled structural decking assembly including a plurality of paver pieces arranged in a pattern over a portion of structural decking panels.

FIG. 5 shows another example of the decking system 100 shown in FIG. 1. As shown in FIG. 5, the decking system 100 includes a series of structural decking panels 108 coupled on a frame upper surface 106 of a bare frame 102. As previously described, a series of paver pieces 110 are installed on the structural decking panels 108. For instance, the paver pieces include a contoured lower surface sized and shaped to engage with panel projections 116 and panel recesses 114. Interfitting of the paver pieces 110 with the corresponding features of the structural decking panel limits lateral movement of the paver pieces 110 in at least one direction and facilitates orientation of the paver pieces 110 into one or more directions for installation in a decorative pattern.

As shown in FIG. 5, installation of the structural decking panels 108 from end to end forms a panel end gap 502. The panel end gap 502 is formed between panel ends 504 of the structural decking panels 108. In one example, fasteners 504 are driven through the structural decking panels 108 at the panel ends 504 to couple the structural panels to the underlying bare frame 102. Similarly, where the structural decking panels 108 are positioned side by side a panel side gap 506 is formed by panel sides 508 of the structural decking panels. Because the paver pieces 110 are installed over the structural decking panels 108, as previously described, the paver pieces 110 conceal the panel end gaps 502, panel side gaps 506 as well as the fasteners 500. The paver pieces 110 when positioned in the decorative configuration conceal unattractive and noticeable gaps between structural decking panels as well as fasteners used to couple the structural decking panels with the bare frame 102. Because the paver pieces 110 are not fastened to the bare frame 102 or the structural decking panels 108 the paver decking surface 112 formed by the paver pieces provides a substantially featureless and aesthetically pleasing appearance. Stated another way, the paver pieces 110 forming a paver decking surface 112 substantially conceal the fasteners 500 as well as the panel end gaps 502 and panel side gaps 506. Further, concealment of the fasteners 500 as well as the panel end gaps and side gaps 502, 506 covers any sharp edges from the panel ends 504 and panel sides 508 as well as any fastener heads that are not entirely flush with the surrounding structural decking panels 108. The plurality of paver pieces 110 installed over the structural decking panels 108 thereby create a smooth surface without snags, burrs and the like.

Figure 6:
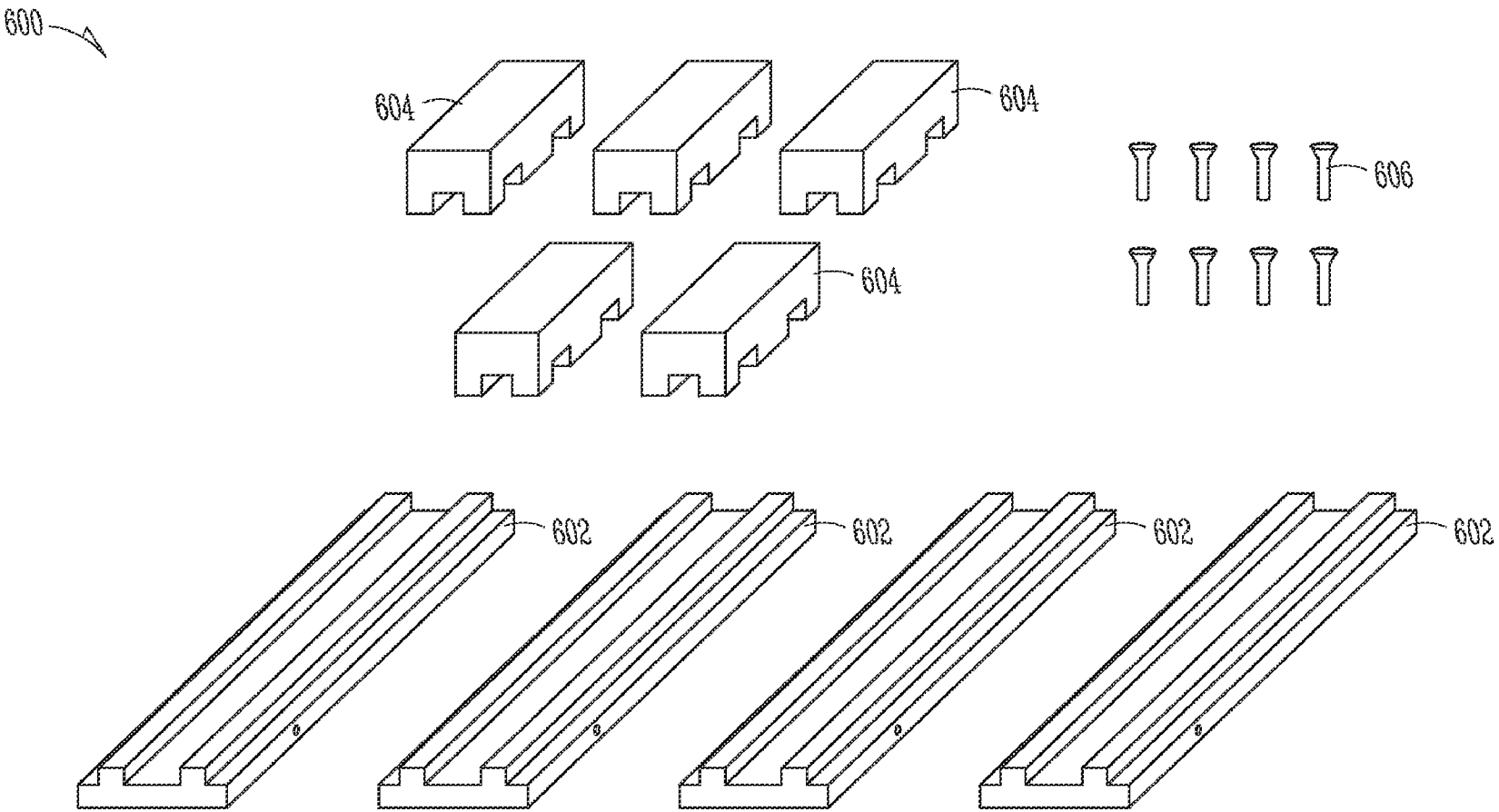
FIG. 6 is a perspective view showing a kit including structural decking panels, fasteners and paver pieces for assembling a structural decking assembly.

FIG. 6 shows one example of a structural decking kit 600 including structural decking panels 602 and paver pieces 604. In one example, the structural decking panels 602 and paver pieces 604 are packaged together and provide sufficient materials for coverage of a specified area (for instance, 20 square feet). Additionally, in another example the structural decking kit 600 includes fasteners 606 sized and shaped to fasten the structural decking panels 602 to an underlying bare frame, such as bare frame 102 (See FIG. 1). In the structural decking kit 600 the plurality of paver pieces 604 are formed with contoured surfaces along the lower portions of the paver pieces sized and shaped to interfit with corresponding contoured surfaces of the structural decking panels 602. As previously described in other examples, the contoured surfaces between the structural decking panel 602 and paver pieces 604 couple and retain the paver pieces 604 on the structural decking panels and also orient the paver pieces in one or more directions. The installer is able to install the paver pieces 604 across the structural decking panel 602 in one or more decorative patterns with the paver pieces 604 arranged in one or more corresponding orientations.

In another example, the structural decking kit 600 includes separate panel projections 404 as shown in FIG. 4. In one option, the structural decking kit 600 includes the paver pieces 604 as well as the separate panel projections 404 and does not include the underlying structural decking panel 400. The installer is thereby able to acquire the structural decking kit 600 with the paver pieces 604, the fasteners 606 (for fastening of the panel projections 404) and the separate panel projections 404 for installation on a previously assembled decking surface. In still another example, the structural decking kit 600 includes the structural decking panel 400 shown in FIG. 4 as well as the separate panel projections 404 in addition to the paver pieces 604 and fasteners 606. The installer then assembles the structural decking panels 400 on the bare frame, fastens the separate panel projections 404 over the structural decking panels 400 and then positions the plurality of paver pieces 604 over the structural decking panels to complete the installation of the decking system. Although FIG. 6 shows one example of structural decking kit 600 including paver pieces 604 similar to the paver pieces 110 shown in FIG. 1 other paver pieces shown herein as well as their equivalents with the corresponding structural decking panels are included in other exemplary structural decking kits.

Figure 7:
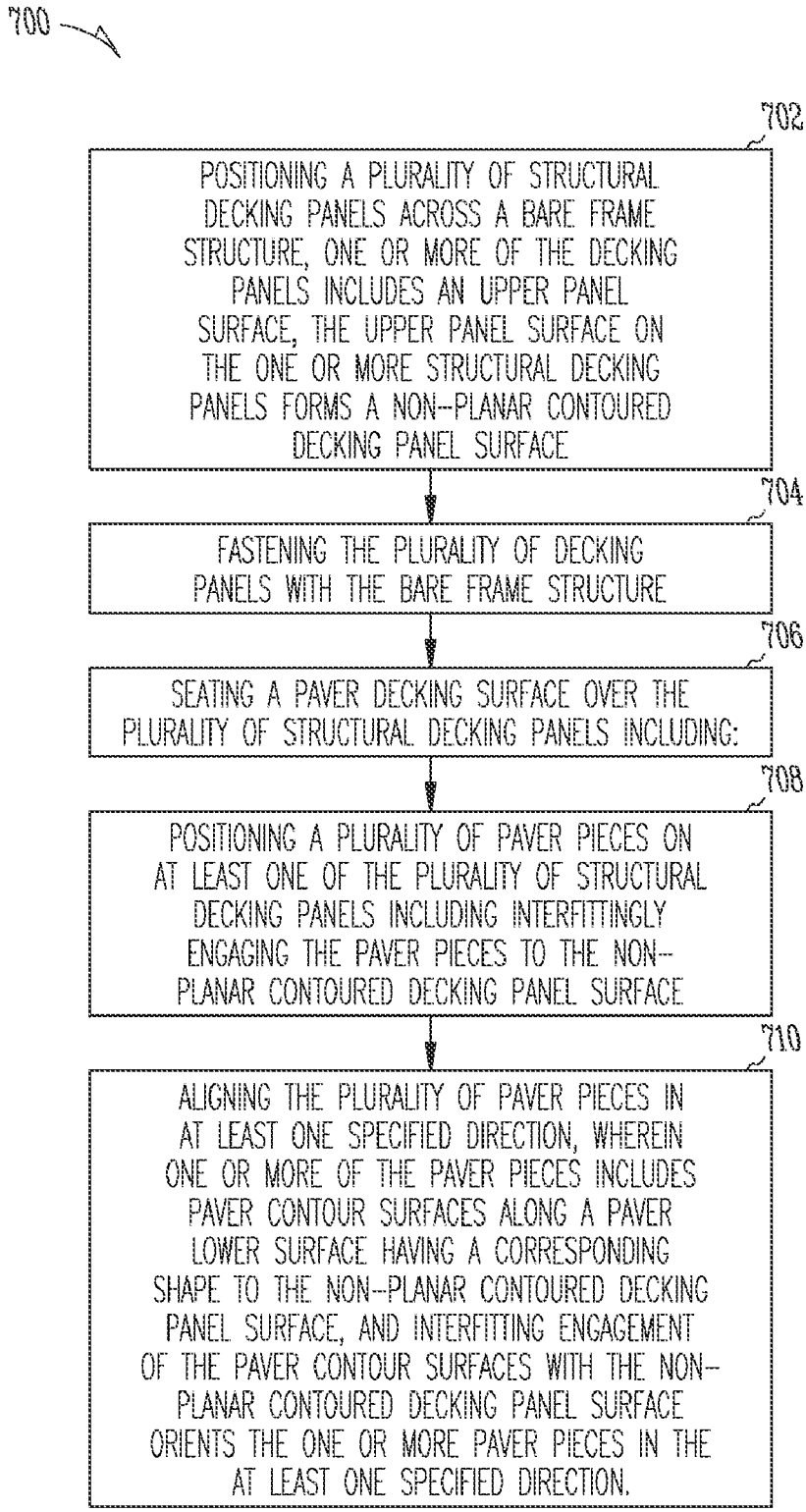
FIG. 7 is a block diagram showing one example for forming a structural decking assembly.

Referring now to FIG. 7, one example of a method 700 for forming a structural paver deck assembly is shown. Reference is made in the description of the method 700 to features and elements previously described. Reference to specific element numbers is not intended to be limiting and instead includes reference to all similar features herein as well as their equivalents. At 702, a plurality of structural decking panels 108 are positioned across a bare frame 102. One or more of the structural decking panels 108 includes an upper panel surface 114. The upper panel surface 114 on the one or more structural decking panels forms a non-planar contoured decking panel surface extending across the structural decking panels. For example, the non-planar contoured surface includes corrugated features from panel projections 116 and panel recesses 114 as shown in FIG. 1. In other examples, the contoured surface includes a series of projections formed in one or more directions on the structural decking panels 108. The contoured surface interfits with corresponding surfaces on a plurality of paver pieces 110 to position and orient the paver pieces on the structural decking panels.

At 704, the plurality of structural decking panels 108 are fastened with the bare frame structure 102. For instance, fasteners 500 are driven through the structural decking panels 108 to fasten the structural decking panels on the frame upper surface 106 of the bare frame 102. In another example, the structural decking panels 108 are coupled with the bare frame 102 through welds, adhesives and the like.

At 706, a paver decking surface 112 is seated over the plurality of structural decking panels 108 and forms the assembled decking system 100 (see FIG. 1). At 708, in one example, seating of the paver decking surface 112 includes positioning a plurality of paver pieces 110 on at least one of the plurality of structural decking panels 108. Positioning the plurality of paver pieces 110 includes interfitting the paver pieces 110 to the non-planar contour decking panel surface formed by the upper panel surface 114 and the structural decking panels. For instance, the paver projections 120 and paver recesses 122 are interfit with corresponding panel recesses 114 and panel projections 116.

At 710, seating of the paver decking surface 112 includes in another example aligning the plurality of paver pieces 110 in at least one specified direction (e.g., directions 202, 204 shown in FIG. 2B). One or more of the paver pieces 110 includes a paver contour surface 308 along a paver lower surface having a corresponding shape to the non-planar contour decking panel surface of the upper panel surface 114. Interfitting of the paver contour surface 308 with the non-planar contour decking panel surface orients the one or more paver pieces 110 in the at least one specified direction.

Several options for the method 700 follow. In one example, positioning of the plurality of structural decking panels 108 across the bare frame structure 102 includes positioning one or more structural decking panels 108 having a paver rail, such as panel projection 116. The non-planar contoured decking panel surface formed along the upper panel surface 114 of the structural decking panels 108 includes the paver rail. That is to say, the paver rail or panel projection 116 provides a corrugated and thereby contoured surface to the upper panel surface 114 for interfitting with corresponding features on the plurality of paver pieces 110.

In still another example, positioning of the plurality of paver pieces 110 on at least one of the plurality of structural decking panels 108 includes slidably engaging the paver pieces with the paver rail 116. As shown in FIG. 1, the plurality of paver pieces 110 include at least one paver recess 122 sized and shaped to receive the panel projection 116 (e.g., the paver rail) of the structural decking panel 108. The paver pieces 110 slide along this paver rail in a loose configuration to allow arrangement of the paver pieces 110 in a specified decorative pattern. The paver pieces are then slid along the panel projection 116 and packed tightly by sliding into engagement as shown in FIG. 1.

In still another example, the aligning of the plurality of paver pieces 110 in at least one specified direction (e.g., directions 202, 204 shown in FIG. 2B) includes aligning the rail recesses 114 with the paver rail 116 of the structural decking panel 108. Stated another way positioning of the plurality of paver pieces on the paver rail 116 optionally orients the paver pieces 110 in one or more directions for easy configuration into a decorative pattern. In still another example, slidable engagement of the paver pieces 110 with the structural decking panels 108 includes slidably anchoring the paver pieces on the paver rail 116 and constraining lateral movement of the paver pieces 110 away from the structural decking panel 108. For example, where the structural decking panel includes a paver recess cavity 368 as shown in FIG. 3E and a paver recess flange 372 lateral movement of the paver piece 360 relative to the structural decking panel 358 is substantially prevented except for longitudinal movement along the panel projection 363. Other lateral movement of the paver piece 360 such as movement left or right or upward relative to the structural decking panel 358 is substantially prevented.

In another example, the method 700 includes coupling a paver rail such as the panel projection 404 shown in FIG. 4 to one or more of the structural decking panels 402 to form the non-planar contoured decking panel surface. In still another example, the method 700 includes rotatably fitting the paver pieces, such as paver piece 360, with the plurality of structural decking panels as shown in FIG. 3F. The paver piece 360 is rotated with one the paver recess flange 372 positioned beneath the panel projection head 382 and the paver pieces snap fits on to the panel projection 376.

In other examples, the method 700 includes fastening the one or more decking panels 108 across the bare frame 102 where the structural decking panels are directly coupled to the bare frame including headers and stringers without interposing deck boards therebetween. In still another example, seating of the paver decking surface over the plurality of structural decking panels 108 substantially conceals fasteners 500 and gaps 502, 504 (see FIG. 5) between the structural decking panels and thereby presents a smooth decorative surface free of burrs and snags from the fasteners and decking panel ends and sides. Optionally, one or more of the plurality of paver pieces 110 are coupled across a panel end gap 502 or panel side gap 504 as shown in FIG. 5.

CONCLUSION

The decking system described herein provides a structurally braced system for support a paving surface on a deck frame. The decking system supports and braces the paving surface (e.g., paver pieces and contoured structural decking panels) without needing existing decking boards as a base interposed between the bare frame of the deck and the structural decking panels. Instead, the structural decking panels are installed over the bare frame, and the interfitting features of the structural decking panels are engaged with the paver pieces to complete the paving surface.

Further, the interfitting of the paver pieces with the features of the structural decking panels, such as the panel recesses and projections, automatically orients the paver pieces during placement of the pieces on the panels. Engagement of the interfitting features between the paver pieces and the decking panels orients the paver pieces in one or more directions. For instance, as the installer couples the paver pieces with the structural decking panels interfitting of the features of the paver pieces and the panels is reached when the paver pieces are oriented in one or more specified directions (e.g., a first direction and a second direction at a right angle to the first). Because of this automatic aligning and orienting of the paver pieces, decorative paver patterns are easily assembled on the paving surface without measuring, subsequent placement including fastening and adjustment (e.g., tapping).

Moreover, the paver pieces overlay the structural decking panels and conceal gaps between the panels as well as fasteners used to couple the panels with the bare frame. Unattractive and rough edges at the gaps, burrs and snags are thereby substantially minimized. Further still, the paver pieces provide protection to the structural decking panels by concealing the panels for ultraviolet light exposure (e.g., sunlight). Warping and breakdown of the structural decking panels is thereby minimized. Additionally, the user can easily replace one or more paver pieces as needed because of damage to the paver pieces. A paver piece is removed from the structural decking panels by pulling up of the paver piece or disengaging a snap fit, and a replacement paver piece is positioned at the same location. Time consuming and expensive unscrewing or prying of nails to replace entire deck boards is thereby avoided.

Although the present invention has been described in reference to preferred embodiments, persons skilled in the art will recognize that changes may be made in form and detail without departing from the spirit and scope of the invention.

It is to be understood that the above description is intended to be illustrative, and not restrictive. Many other embodiments will be apparent to those of skill in the art upon reading and understanding the above description. It should be noted that embodiments discussed in different portions of the description or referred to in different drawings can be combined to form additional embodiments of the present application. The scope of the invention should, therefore, be determined with reference to the appended claims, along with the full scope of equivalents to which such claims are entitled.

What is claimed is:

1. A method for forming a structural paver deck assembly comprising:

fastening one or more structural decking panels across a frame structure, the one or more structural decking panels include longitudinal panel edges, more than one of the structural decking panels of the one or more structural decking panels including at least one of panel recesses and panel projections on an upper decking panel surface, wherein the at least one of panel recesses or panel projections are between the longitudinal panel edges, and the panel projections on the upper decking panel surface include at least one paver rail, and the at least one paver rail extends in one or more of a width or length of the structural decking panel;

seating a paving decking surface over the one or more of structural decking panels including snap fitting a plurality of paver pieces along the one or more structural decking panels, the plurality of paver pieces including at least one of paver projections or paver recesses, where at least one of the panel projections are received within the paver recesses or the paver projections are received in the panel recesses, wherein the paver recesses of one or more paver pieces of the plurality of paver pieces include tapered rail recesses receiving the at least one paver rail, the tapered rail recesses taper toward a paver lower surface and the at least one paver rail includes a corresponding rail taper, the one or more paver pieces are slidably coupled along the at least one paver rail, and the tapered rail recesses and the rail taper laterally lock the one or more paver pieces on the paver rail, and the one or more structural decking panels are configured to support the weight of the paving decking surface.

2. The method of claim 1, wherein fastening one or more structural decking panels across the frame structure includes fastening the one or more structural decking panels directly to a frame structure of headers and stringers.

3. The method of claim 1 further comprising concealing fasteners on the upper decking panel surface with the plurality of paver pieces.

4. The method of claim 1, wherein fastening the one or more structural decking panels across the frame structure includes forming gaps between the one or more structural decking panels at one or more of panel ends and panel sides, and seating the paving decking surface over the one or more structural decking panels includes concealing the gaps.

5. The method of claim 4, wherein concealing the gaps between structural decking panels includes coupling at least one of the plurality of paver pieces across the structural decking panels.

6. The method of claim 1, wherein seating the paving surface over the one or more structural decking panels to form a paver decking surface includes seating a plurality of paver pieces resistant to ultraviolet light over the one or more structural decking panels including composite material decking panels to protect the composite material decking panels from ultraviolet light.

7. The method of claim 1, wherein seating the paving surface over the one or more structural decking panels to form a paver decking surface includes slidably coupling the one or more of the paver projections and paver recesses of the plurality of paver pieces on one or more of the panel recesses and panel projections of the structural decking panels.

8. The method of claim 7, wherein seating the paving surface over the one or more structural decking panels to form the paver decking surface includes:

sliding a first paver piece into a first position on at least one structural decking panel, and sliding a second paver piece into a second position on the at least one structural decking panel, and the second paver piece is immediately adjacent to the first paver piece.

9. The method of claim 1 further comprising engaging one or more of the plurality of paver pieces with flanges extending around at least a portion of the frame structure, and retaining the plurality of paver pieces on the upper panel surface with the flanges.

10. A method for forming a structural paver deck assembly comprising:

positioning a plurality of structural decking panels across a bare frame structure, one or more of the decking panels includes an upper panel surface, the upper panel surface on the one or more structural decking panels forms a non-planar contoured decking panel surface, and one or more structural decking panels include at least one paver rail on the non-planar contoured decking panel surface, and the at least one paver rail extends in one or more of a width or length of the structural decking panel;

fastening the plurality of decking panels with the bare frame structure; and seating a paver decking surface over the plurality of structural decking panels including:

positioning a plurality of paver pieces on at least one of the plurality of structural decking panels including rotatably snap fitting the paver pieces to the non-planar contoured decking panel surface, aligning the plurality of paver pieces in at least one specified direction, wherein one or more of the paver pieces includes paver contour surfaces along a paver lower surface having a corresponding shape to the non-planar contoured decking panel surface, and interfitting engagement of the paver contour surfaces with the non-planar contoured decking panel surface orients the one or more paver pieces in the at least one specified direction, wherein one or more paver pieces of the plurality of paver pieces include tapered rail recesses receiving the at least one paver rail, the tapered rail recesses tapering toward the paver lower surface and the at least one paver rail includes a corresponding rail taper, and the one or more paver pieces are slidably coupled along the at least one paver rail, and interlocking and fixing the plurality of paver pieces against displacement relative to each other and the structural decking panels according to the interfitting engagement of the paver pieces to the non-planar contoured decking panel surface, the tapered rail recesses and the rail taper laterally lock the paver plurality of papers pieces on the paver rail.

11. The method of claim 10, wherein positioning the plurality of structural decking panels across the frame structure includes positioning one or more structural decking panels having a paver rail, and the non-planar contoured decking panel surface includes the paver rail.

12. The method of claim 11, wherein positioning the plurality of paver pieces on at least one of the plurality of structural decking panels includes slidably engaging the paver pieces with the paver rail, where the paver pieces include a rail recess configured to receive the paver rail.

13. The method of claim 12, wherein aligning the plurality of paver pieces in at least one specified direction includes aligning the rail recesses of the paver pieces with the paver rail.

14. The method of claim 12, wherein slidably engaging the paver pieces with the paver rail includes slidably anchoring the paver pieces on the paver rail, and constraining lateral movement of the paver pieces away from structural decking panel including the paver rail.

15. The method of claim 10 further comprising coupling a paver rail to one or more of the structural decking panels to form the non-planar contoured decking panel surface.

16. A structural deck assembly comprising:

one or more structural decking panels configured for fastening across a frame structure, the one or more of the structural decking panels include at least one of panel recesses and panel projections on an upper decking panel surface, and the at least one of panel recesses or panel projections are between longitudinal panel edges of the structural decking panels; and a paving surface coupled with the one or more structural decking panels to form a paver decking surface, the paving surface includes a plurality of paver pieces, one or more of the paver pieces including:

paver recesses having a snap fit feature sized and shaped for snap fitting with the structural decking panels, the paver recesses are configured to receive the panel projections, and the snap fit feature includes an L-shaped paver recess and the structural decking panels include sa correspondingly shaped panel projection, and the one or more structural decking panels are configured to support the weight of the paving decking surface.

17. The structural deck assembly of claim 16, wherein the structural decking panels are fastened directly to a frame structure of headers and stringers.

18. The structural deck assembly of claim 16, wherein the paving surface conceals fasteners on the upper decking panel surface.

19. The structural deck assembly of claim 16, wherein the one or more structural decking panels includes a plurality of structural decking panels fastened to the bare frame structure with gaps between the structural decking panels at one or more of the panel ends and panel sides, and the paving surface conceals the gaps.

20. The structural deck assembly of claim 16, wherein one or more of the plurality of paver pieces extends over the gaps.

21. The structural deck assembly of claim 16, wherein the one or more structural decking panels include composite material decking panels, and the plurality of paver pieces are resistant to ultraviolet light and protect the composite material decking panels from ultraviolet light where the paver decking surface extends over the one or more structural decking panels.

22. The structural deck assembly of claim 16, wherein one or more of the paver projections and paver recesses of the plurality of paver pieces are slidably coupled along one or more of the panel recesses and the panel projections of the structural decking panels.

23. The structural deck assembly of claim 16 further comprising a flange extending around at least a portion of the upper decking panel surface.

24. The structural deck assembly of claim 16 further comprising:

a plurality of fasteners configured to fasten the one or more structural decking panels with the frame structure, the fasteners are configured to extend through one or more of the one or more structural decking panels and are visible on the upper decking panel surface when extending through the structural decking panels; and wherein the plurality of paver pieces are configured to conceal the plurality of fasteners when coupled with the structural decking panels.

25. A structural paver deck assembly comprising:

a one or more structural decking panels coupled across a frame structure, one or more of the structural decking panels includes an upper panel surface, the upper panel surface forms a non-planar contoured decking panel surface, and one or more structural decking panels include at least one paver rail on the non-planar contoured decking panel surface, and the at least one paver rail extends in one or more of a width or length of the structural decking panel; and a paving surface coupled over the one or more structural decking panels including:

a plurality of paver pieces each including non-planar paver contour surfaces on paver bottoms interfit and complementary to the non-planar contoured decking panel surface, wherein one or more paver pieces of the plurality of paver pieces include tapered rail recesses receiving the at least one paver rail, the tapered rail recesses taper toward a paver lower surface and the paver rail includes a corresponding rail taper, and the one or more paver pieces are slidably coupled along the at least one paver rail, whereby the non-planar paver contour surfaces and contoured decking panel surface permit the orientation of a first set of paver pieces of the plurality of paver pieces in a first specified direction according to the interfitting, and further permit the orientation of a second set of paver pieces of the plurality of paver pieces in a second specified direction different from the first specified direction according to the interfitting, wherein interfitting of the non-planar paver contour surfaces on the paver bottoms to the non-planar contoured decking panel interlocks and fixes the first and second sets of the paver pieces both in the respective first and second specified directions and against displacement relative to each other and the one or more structural decking panels, the tapered rail recesses and the rail taper laterally lock the plurality of paver pieces on the paver rail.

26. The structural paver deck assembly of claim 25, wherein the non-planar contoured decking panel surface is formed by the at least one paver rail and the remainder of the contoured decking panel surface is recessed relative to the at least one paver rail.

27. The structural paver deck assembly of claim 25, wherein the paver rail is coupled with the one or more structural decking panels.

28. The structural paver deck assembly of claim 25, wherein a first structural decking panel includes a first paver rail a second structural decking panel includes a second paver rail, and a first paver piece is slidably coupled along the first paver rail and a second paver piece is slidably coupled along the second paver rail.

29. The structural paver deck assembly of claim 28, wherein the first paver rail and the second paver rail extend in the same direction.

30. The method of claim 1, wherein fastening one or more structural decking panels includes fastening one or more structural decking panels including at least one of panel recesses and panel projections that are integral to the structural decking panel.

31. The method of claim 16, wherein the at least one of panel recesses or panel projections are integral to the one or more structural decking panels.

32. The structural paver deck assembly of claim 25, wherein the non-planar paver contour surfaces include at least one of paver projections and paver recesses along the paver bottoms.

33. The structural paver deck assembly of claim 32, wherein at least one of the paver projections and paver recesses are sized and shaped to interfit with the non-planar contoured decking panel surface and orient the plurality of paver pieces in only the first and second specified directions.

34. The structural paver deck assembly of claim 32, wherein the non-planar paver contour surfaces include snap fitting features configured for snap fitting with corresponding features included with the non-planar contoured decking panel surface.

* * * * *

UNITED STATES PATENT AND TRADEMARK OFFICE

CERTIFICATE OF CORRECTION

PATENT NO. : 8,336,278 B2
APPLICATION NO. : 12/717856
DATED : December 25, 2012
INVENTOR(S) : Smith et al.

It is certified that error appears in the above-identified patent and that said Letters Patent is hereby corrected as shown below:

In the Claims

In column 16, line 2, in claim 16, delete "sa" and insert --a--, therefor

Signed and Sealed this
Twenty-sixth Day of November, 2013

Margaret A. Focarino

Margaret A. Focarino
*Commissioner for Patents of the United States Patent and Trademark Office*